US005379551A

United States Patent [19]

Swapp

[11] Patent Number: 5,379,551

[45] Date of Patent: Jan. 10, 1995

[54] WINDOW SHUTTER

[76] Inventor: Ronald L. Swapp, 3547 E. Fairfield, Mesa, Ariz. 85213

[21] Appl. No.: 980,196

[22] Filed: Nov. 20, 1992

[51] Int. Cl.[6] ..... E06B 7/08

[52] U.S. Cl. ..... 49/82.1; 49/74.1

[58] Field of Search ..... 49/74 L, 82 GR, 91 WS, 49/504; 52/475, 656, 745.15

[56] References Cited

U.S. PATENT DOCUMENTS

| | | | |
|---|---|---|---|
| 2,281,071 | 4/1942 | Knudsen | 49/82 GR |
| 3,284,113 | 11/1966 | Howell | 52/656.1 X |
| 3,290,823 | 12/1966 | Okumoto | 49/74 L |
| 3,940,900 | 3/1976 | Russo | 49/504 X |
| 4,016,694 | 4/1977 | Mauell | 52/475 |
| 4,122,633 | 10/1978 | Holdiman | 49/504 X |
| 4,295,305 | 10/1981 | Shelver | 52/745.15 X |
| 4,689,933 | 9/1987 | Bird | 52/475 X |
| 4,707,963 | 11/1987 | Governale | 52/745.15 |
| 4,783,945 | 11/1988 | Heeg | 52/656.1 |
| 5,001,864 | 3/1991 | Truscott | 49/74 LX |

FOREIGN PATENT DOCUMENTS

| | | | |
|---|---|---|---|
| 1394576 | 2/1965 | France | 52/475 |
| 1511597 | 12/1966 | France | 49/504 |
| 661963 | 12/1978 | Switzerland | 49/504 |
| 8801005 | 2/1988 | WIPO | 49/504 |

*Primary Examiner*—Peter M. Cuomo
*Assistant Examiner*—Jerry Redman
*Attorney, Agent, or Firm*—Gregory J. Nelson

[57] ABSTRACT

A window shutter having vertical stiles and horizontal rails formed of extruded polymeric material. The corners where the rails and stiles are joined are reinforced by interconnected rigid load-transferring member. Louvers are moveable relative to the stiles and pivot on molded pins which may be provided with individual gears engageable with an elongate rack for synchronized movement. The invention comprehends a fabrication and assembly process.

4 Claims, 3 Drawing Sheets

WINDOW SHUTTER

The present invention relates to a window shutter and more particularly relates to a window shutter fabricated at least partially from synthetic materials and also to the method of making a shutter from synthetic materials which shutters have the appearance of a wood shutter.

Various interior window treatments are utilized in residence and commercial businesses. One widely used and accepted window treatment is the shutter. The shutter is popular because of its pleasing aesthetic appearance, versatility, adjustability and functionality. Shutters can be manufactured to accommodate window openings of almost all sizes and shapes. Shutters conventionally are made of wood and are fabricated and assembled in a highly labor-intensive operation. Generally these shutters are stained or painted. A functional advantage of shutters is that shutters can be adjusted to adjust the desired light level and also serve to deflect sunlight and reduce glare. Shutters also serve to reduce the heat load transferred to an interior area through a window opening.

As indicated above, conventional shutters while widely accepted, are generally quite expensive due to the number of labor operations which must be performed in the fabrication. Most of these operations are manual or at most semi-automatic. For example, the stiles and rails forming the frame must be planed, shaped, drilled and routed in the assembly process. The louvers are similarly formed and assembled as part of the structure. If the louvers are of the adjustable type, the louvers are provided with dowels which are inserted in cooperating bores spaced apart along the edges the stiles.

Subsequent to assembly, gluing and finishing, the shutters may be generally coated either with a stain and varnish or paint. Conventional wooden shutters constructed in this manner are subject to warpage and discoloration as a result of heat transferred through the window opening and also due to ambient environmental conditions.

While as indicated above, shutters are widely accepted, there exists a need for a shutter of improved construction and an improved fabrication technique which would significantly reduce the labor-intensive operations attendant to the fabrication of conventional shutters. There also exists a need for a shutter having a pleasing appearance which shutter will provide better heat and environmental resistance.

Briefly, in accordance with the present invention, a window shutter is provided having vertical stiles and horizontal rails formed of a suitable synthetic polymeric material. Preferred materials are polyvinyl chloride, polystyrene, polyurethane, polypropylene which are preferably extruded and include as an integral part of the extrusion a sealing member along an edge which provides a barrier to transmission of light. The rails and stiles each define a longitudinally extending recess which receive a stiffening member such as an aluminum or wooden tube or rod. The corners of the frames where the rail and stile are joined are reinforced by rigid members which interconnect the reinforcing members in the rail and stile.

The moveable louvers are supported on pivot pins which are injection molded and having a head which may be provided with gear teeth. The heads of the pins are insertable in mounting strips extending along the interior of the vertical stile. A gear rack may be placed in engagement with the gear heads of the pivot pins to facilitate unitary actuation of the louvers, either manually or motorized. The assembly and fabrication involves the steps of molding the rail and stile components, providing reinforcing members, installing the louvers using molded pivot pins which are received in a mounting strip in the inner edge of the stiles.

The above and other objects and advantages of the present invention will become more apparent from the following description, claims and drawings in which:

Figure 1:
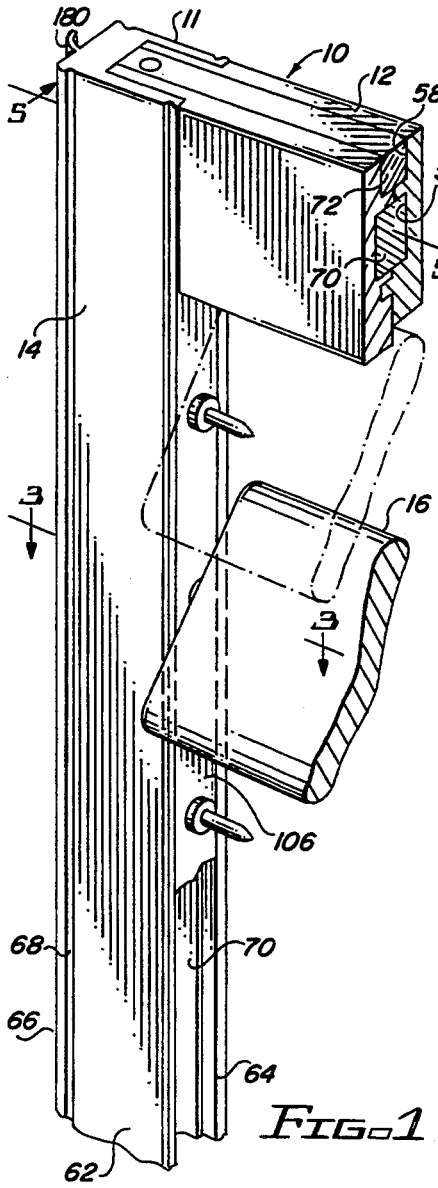
FIG.1 is a perspective view of a portion of the shutter according to the present invention showing the rail, stile and adjustable louvers.

Turning now to the drawings, particularly FIGS. 1 through 9, a preferred embodiment of a shutter according to the present invention is shown and is generally designated by the numeral 10. Broadly the shutter has an upper horizontal rail 12, an outer vertical stile 14 and a plurality of adjustable louvers 16. As is conventional, the complete shutter frame construction 11 includes a lower rail and an inner vertical stile which are not shown since their construction corresponds to that of the rail and stile 12 and 14. The rail is fabricated from opposed members 12A and 12B. Each member is extruded from a suitable synthetic material such as a polymeric material with polyvinylchloride, polyethylene, polystyrene and polypropylene being representative. The components are preferably fabricated with a coloring agent included in the resin and any desired exterior surface treatment is applied in the molding process. Rail component 12A has a generally planar exterior surface 20, top edge 22 and bottom edge 24. The interior surface of rail member 12A is designated by the numeral 25 and defines a lower longitudinally extending recess 26 separated from an intermediate longitudinally extending recess 28 by an upstanding flange 30. Notch 32 extends downwardly from the upper edge 22 and is separated from recess 28 by longitudinally extending flange 34. Rail component 12B is similarly constructed of an extruded synthetic material having an outer surface 40, upper surface 42, bottom edge 44.

The inner surface of the rail member 12B defines a longitudinally extending projection or flange 45 which is adapted to engage recess 26 in rail member 12A. Longitudinally extending projection or flange 44 is spaced-apart from projection 45 and is adapted to abut flange 34 of the opposite rail member 12A. Longitudinally extending recess 48 is defined between the projections. Similarly, a notch 52 extends from the upper edge 42 downwardly to projection 44.

As best seen in FIG. 1, when the components 12A and 12B are placed in engagement and joined by application of an adhesive or by heat bonding or other appropriate joining method. A generally rectangular longitudinally extending channel 56 is defined along the center of the rail. As will be explained in detail hereafter, these openings receive reinforcing or stiffening members. A portion of the end of each of the rail components 12A and 12B may be cut away at 60A and 60B to form a rabbet joint with the vertical stile 14.

The vertical stiles are also formed from a synthetic polymeric material the same as the rails. The stile is preferably an extruded or injection molded member being generally U-shaped in cross section having opposite legs 62 and 64 extending from longitudinal edge section 66. The stile may be provided with a suitable surface treatment and is shown having vertically extending beads 68 at one surface edge or both surfaces. Longitudinally extending recess 70 is defined between the legs 62 and 64 and opens at the inner side of the rail, the inner side of the rail being designated as the side of the rail which is adjacent the louvers 16.

The use of synthetic polymeric materials for the shutter components provides significant advantages including better heat resistance, durability and environmental resistance. However, synthetic materials such as those mentioned above often do not have the inherent rigidity necessary for shutter construction, particularly for larger shutter assemblies. Accordingly, the present invention includes internal structural reinforcement particularly in the corner areas of the shutter frame which serve to provide unitary rigidity to the entire structure and transfer loads away from the corner areas of the shutter. Accordingly, at least one rigid reinforcing member extends longitudinally in each rail extending from the corner of the frame 11. As seen, rail 12 is provided with either one or two such reinforcing members 70 and 72. The members 70 and 72 may be a wood such as a hard wood or may be a rigid plastic such as a nylon, styrene or ABS. Members 70 and 72 are received in the respective longitudinal channels 56, 58 and may be secured therein by a suitable adhesive.

Figure 2:
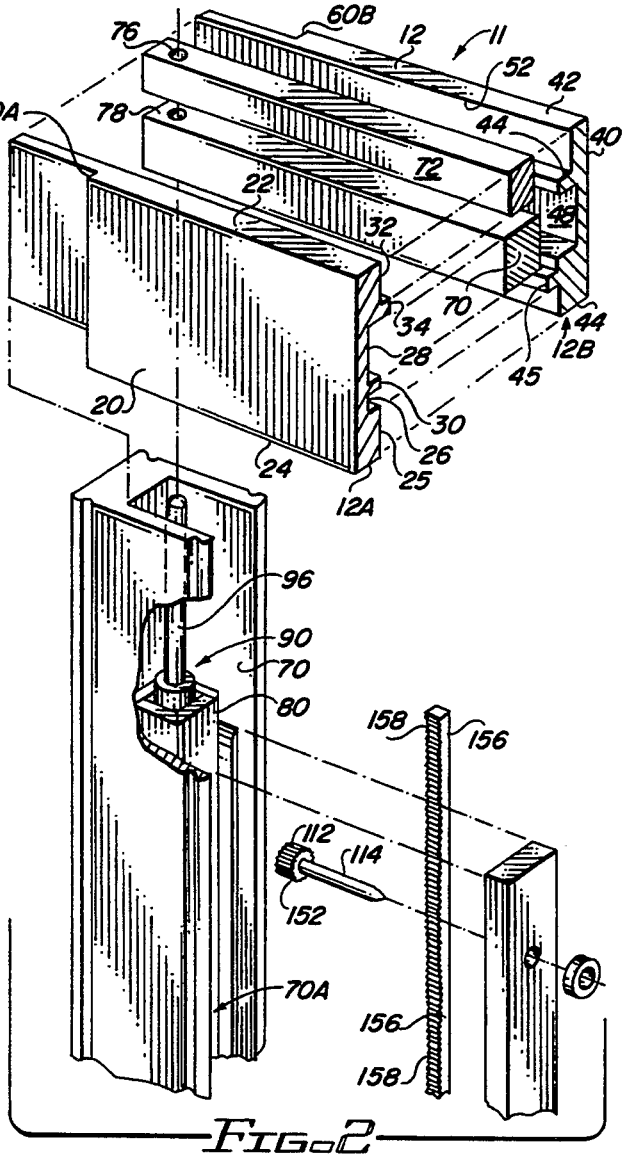
FIG. 2 is an exploded view of the construction shown in FIG. 1.
Figure 3:
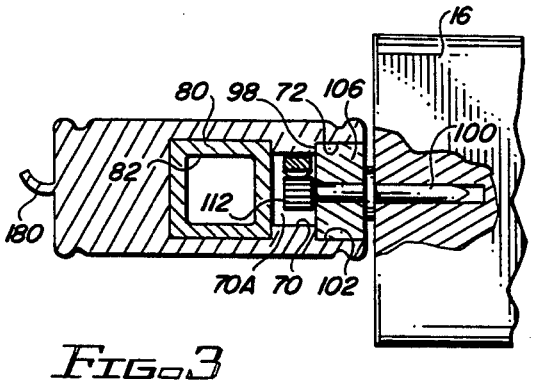
FIG. 3 is a sectional view taken along line 3—3 of FIG. 1.

As best seen in FIG. 2, the reinforcing members 70 and 72 each define aligned vertical bores 76 and 78, respectively, spaced inwardly from the end of the rail. A rigid reinforcing member 80 extends vertically within the recess 70 of the vertical stile. The reinforcing member 80 which may be wood, plastic or metal and is shown as an extruded aluminum tubular member which is generally rectangular in cross section defining a rectangular centrally extending opening 82. The reinforcing member 80 extends vertically along the stile from a location approximately corresponding to the lower edge of the rail in the assembled position. The member 80 may extend the full length of the stile or at least the substantial vertical distance downwardly from its upper end.

Figure 4:
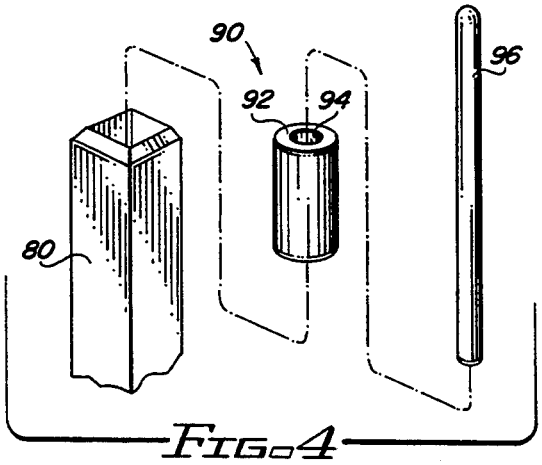
FIG. 4 is an exploded detail view of the reinforcing components shown in FIG. 1.
Figure 5:
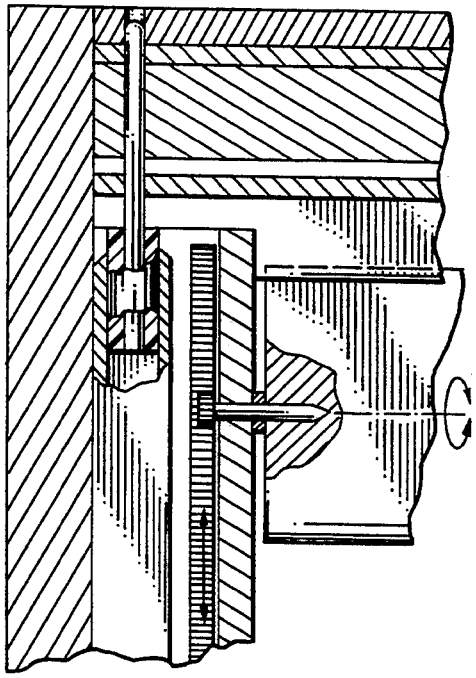
FIG. 5 is a sectional view taken along line 5—5 of FIG. 1.
Figure 9A:
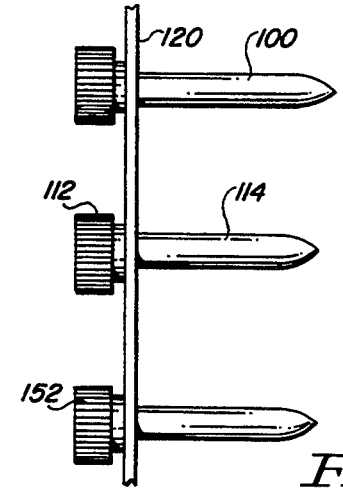
FIGS. 9A-9G illustrate the sequence and operation in removing the individual pivot pins from the runner and assembling them into the vertical stile of the shutter.
Figure 9B:
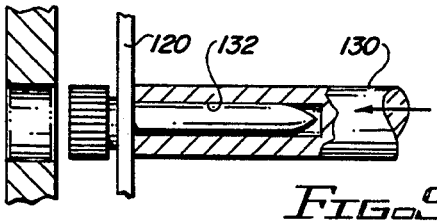
Figure 9C:
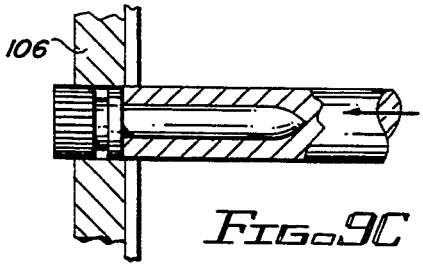
Figure 9E:
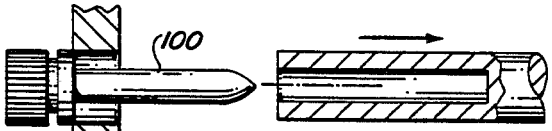
Figure 9F:
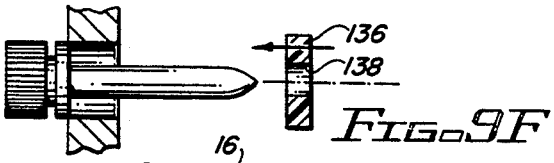
Figure 9D:
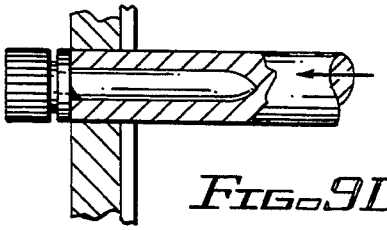
Figure 9G:
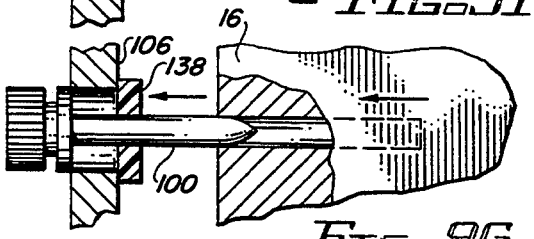
Figure 6:
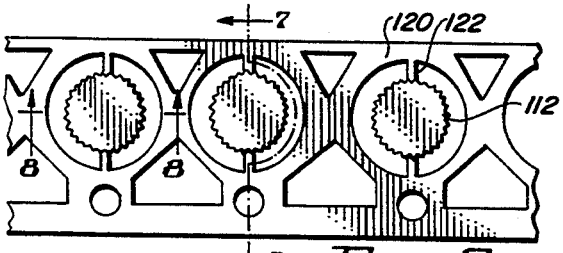
FIG. 6 is a plan view of a portion of a runner with injection molded pivot pins attached thereto.
Figure 7:
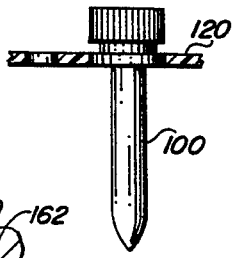
FIG. 7 is a sectional view of the runner taken along line 7—7 of FIG. 6.
Figure 8:
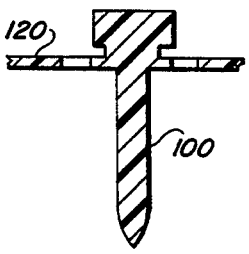
FIG. 8 is a sectional view taken along line 8—8 of FIG. 6.

A connector assembly 90 is provided at each corner of the frame 11 to connect the vertical and horizontal reinforcing members and to transfer loads away from the corner of the shutter frame. One form of the connector 90 is seen in FIGS. 2 and 4 and consists of a cylindrical insert 92 defining an axially extending bore 94. The insert 92 may be of any suitable material such as nylon and is snugly received in the upper end of the vertical member 80 in opening 82. A rigid pin 96 is insertable in the bore 94 of the insert. The pin 96 projects upwardly and is engageable in bores 76 and 78 of the rail reinforcing members 70 and 72. It will be appreciated that with this construction the rigid members 80, 70 and 72 are interconnected by the connector assembly 90 to provide integrity and rigidity to the entire shutter frame construction. The remaining three corners of the shutter frame are similarly constructed and reinforced and detailed description of these corners is not necessary and would be unnecessarily repetitious.

Shutters are generally provided with louvers extending either vertically or horizontally which louvers may be fixed or adjustable. The present invention provides a moveable louver structure and assembly method which is shown in conjunction with horizontal louvers but may be utilized with vertical louvers.

The individual louvers 16 are provided with axially extending pivot pins 100 which support the louvers for rotation. The end of the pivot pins are received in the recess 70 vertically extending in the side rails. The recess 70 is provided with a shoulder 102 which receives elongate mounting strip 106. The mounting strip 106 may be of wood or plastic and is provided with spaced-apart bores 110 which receive the end of the pivot pins. The head end 112 of the pivot pins are received in vertically extending channels 70A defined between the rigid member 80 and the insert strip 106.

The pivot pins may be fabricated from metal but preferably are formed by injection molding and provided on a runner 120 as best seen in FIGS. 6 through 9. The individual pins have a head 112 and an elongate body 114 with the portion of the pin being attached to the runner by gate 122. The pins are provided to the assembler attached to the runner for convenience of assembly. In this way, individual pins are not as easily dropped or misplaced. Further, the spacing "S" between individual pins is selected to correspond to the spacing between the bores 110 in the mounting strip 106. Providing the pivot pins as part of a runner assembly with predetermined spacing between the pins accommodates assembly as best illustrated in FIGS. 9B through 9G. In the assembly procedure, the runner with the attached pivot pins 110 is placed in alignment with the mounting strip 106. A tool having a plurality of heads 130 is shown in FIG. 9B is brought into axial alignment with the pins. The tool 130 is provided with an axial bore 132 which receives the shaft of the pins. The tool is extended either manually or automatically as shown in FIGS. 9C and 9D, causing the individual pins to be severed from the runner at the connecting gates 122. The bores 110 in the strip 106 are of sufficient diameter to permit the head 112 of the pin to pass through the strip to be received in the vertical channel 70A. The tool is withdrawn as shown in FIG. 9E and thereafter a washer 136 with a central aperture 138 is secured over the shaft of the pivot pin. The washer may be of any suitable material such as nylon and is interposed between the mounting strip 106 and the louver 16. The louver 16 is then positioned over the shaft 114 of the pin. The operation of positioning the washer and the individual louvers can be done one at a time or may be done on an automated basis with the selected number of louvers held in place in proper position by fixture and brought into engagement with the respective pivot pins.

Once the louvers have been positioned at one vertical stile, the opposite stile is brought into position in engagement with the upper and lower rails and with the pivot pins extending from the louvers and secured by an adhesive or bonding agent. Each corner of the frame has a connector assembly. The same frame construction technique would be applicable on a frame 11 having fixed louvers or without louvers.

In the event the completed shutter is to be provided with manually adjustable louvers, a conventional adjustment rod is vertically attached to an edge of the louvers at a central location by a hinge joint, generally consisting of interlocking staples.

If the shutter is to be a motorized unit, the heads 112 of the individual pins are fabricated having gear teeth 152 formed therein. The gear teeth are adapted to engage with a vertically extending rack 156 having cooperating teeth 158. The rack is inserted in the vertically extending channel 70A in engagement with the gear teeth on the head of the individual pins. The rack which serves as an actuator for the coordinated movement of louvers may be manually actuated at its lower end or may be suitably connected to a small motorized operator such as a small gear motor as is conventional.

Figure 11:
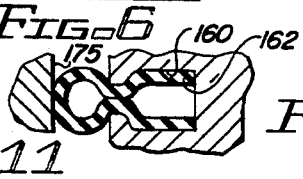
FIG. 11 is a transverse cross-sectional view showing the elastomeric seal member installed along the edge of a shutter component to provide a light seal or barrier.

Generally shutters of the type described above are mounted in either a suitable peripheral frame or positioned within a window recess and secured to the frame or window by hinges. The mating edges of the vertical stiles of a pair of adjacent shutter units as well as the outer horizontal edges of the upper and lower rails often permit passage of some light therethrough. To this end, selected outer edges of the shutter frame may be grooved as seen in FIG. 11 with longitudinally extending groove 160 provided therein. A suitable elastomeric seal 162 may be inserted in the groove 160. The elastomeric seal is shown as having a generally circular outer beam 164 with a reduced area neck 162 and oppositely extending legs 168 and 170. As seen in FIG. 11, the elastomeric member is insertable in the grooves with the legs 168 and 170 received in the groove and the circular sealing member received between an edge of the shutter and the corresponding edge 175 of the adjacent member which may be a frame or another shutter component.

Figure 10:
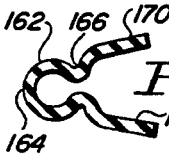
FIG. 10 is a transverse cross-sectional view of an elastomeric seal member.
Figure 12:
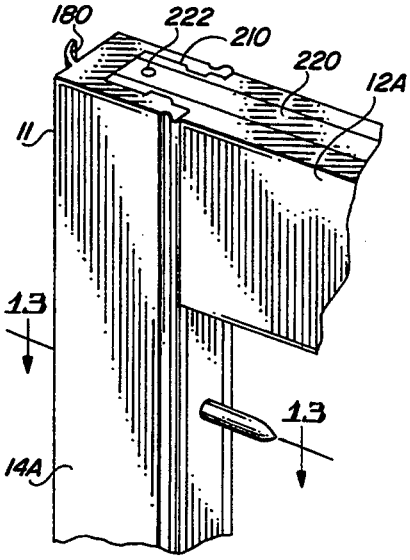
FIG. 12 is a perspective view of a corner portion of an alternate embodiment of the shutter.
Figure 13:
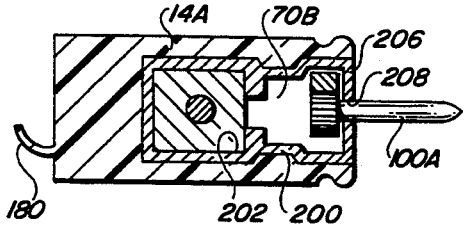
FIG. 13 is a sectional view taken along line 13—13 of FIG. 12.

As an alternate to the light seal shown in FIGS. 10 and 11, the projecting elastomeric light seal may be formed as projecting flap 180 extruded or molded as an integral part of the shutter component. In FIGS. 12 and 13 a vertical stile is shown formed having a flap 180 formed as thin projecting elastomeric member which will serve as an effective light seal.

Figure 14:
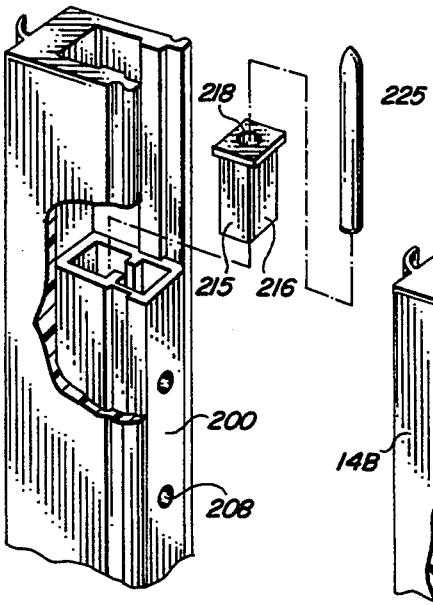
FIG. 14 is a perspective view of a portion of the shutter stile partly broken away and showing the corner reinforcing components in exploded representation.

Also referring to FIGS. 12 through 14, an alternate embodiment of the invention is shown in which a corner of the shutter frame 11 is represented having a horizontally extending rail 12A and a vertically extending stile 14A. The stile 14A is formed of a suitable synthetic polymeric material and is preferably extruded or injection molded. In the embodiment shown in FIGS. 12 to 14, the rigid reinforcing member 200 is integrally formed with the stile in the fabrication process. Rigid reinforcing member 200 may be a channel or formed of aluminum or a rigid plastic and defining a generally rectangular section 202. The opposite side of the rigid reinforcing member has a planar surface 206 which is positioned to extend between the opposite legs of the stile 14A and is provided with a plurality of spaced apart holes 208 which will receive the pivot pins 100A. A portion of the rigid reinforcing member defines a vertically extending channel 70B which receives the head of the individual pivot pins.

As best seen in FIG. 14, the rigid reinforcing member terminates at a predetermined distance from the end of the stile to facilitate insertion of the rail 12A. The rail 12A is suitably provided with a configuration at 210 conforming to the interior configuration of the distal end of the stile so that these components may be placed in locking engagement.

The corner is reinforced in a manner similar that shown in FIG. 4. An insert 215 having a generally rectangular body 216 defines an axially extending bore 218. The insert 215 is receivable within section 202 of the rigid reinforcing member. The one or more horizontally extending reinforcing members in the rail 220 are provided with vertical bore 222 which aligns with the aperture 218 in the insert. A connecting member 225 is inserted through the bore 222 into the connector bore to provide interlocking engagement between the vertical and horizontal reinforcing members.

Figure 16:
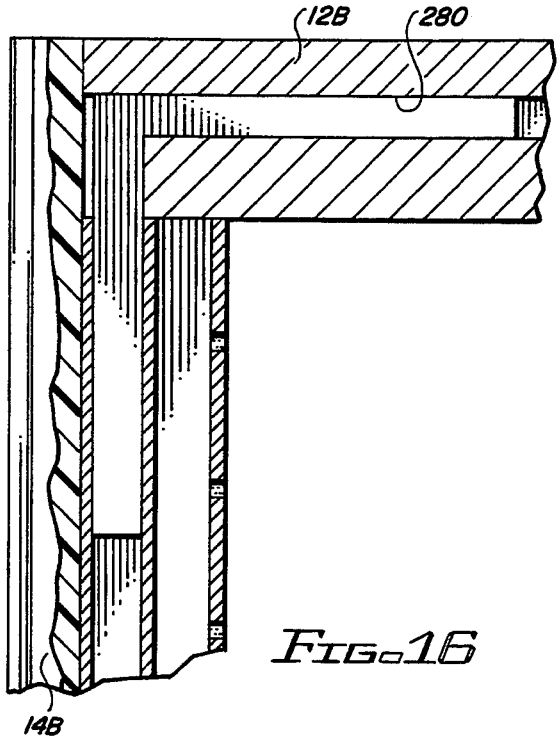
FIG. 16 is a plan view of a corner of the shutter shown in FIG. 15 broken away to illustrate the internal components.
Figure 15:
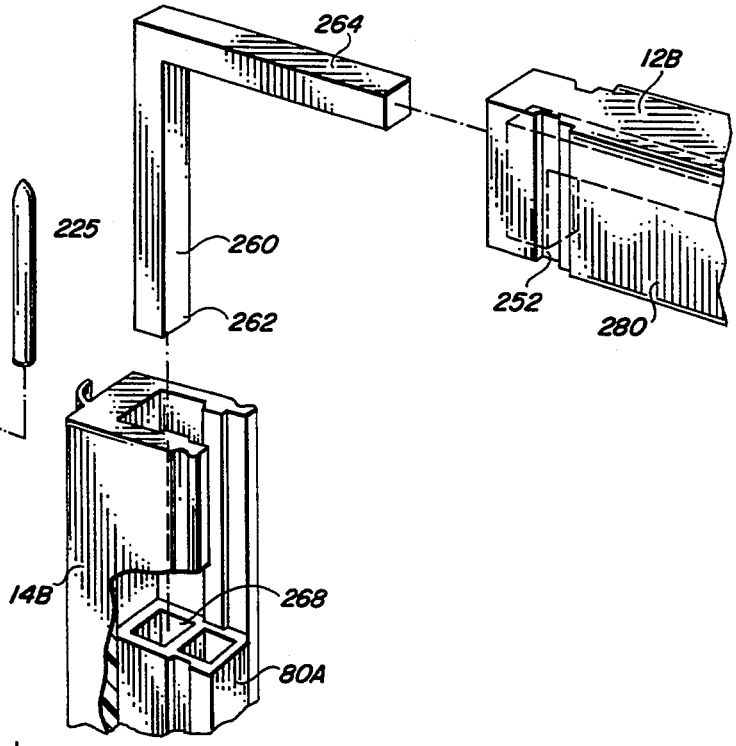
FIG. 15 is an exploded perspective view of another embodiment of the shutter assembly.

FIGS. 15 and 16 show still an alternate construction for the corners of the shutter frame. Vertical stile 14B is connected to horizontal rail 12B. Both the rail and stile are formed of a synthetic material as has been set forth above. A rigid reinforcing member shown as extruded aluminum section 80A is received within the vertical stile 14B. The horizontal rail 12B defines a horizontally extending channel or opening 250. Reinforcing member 80A terminates a predetermined distance above the upper end of the vertical stile. The end of the rail is configured at 252 to be received and inner engage the upper end of the stile. A connector bracket 260 is formed of rigid material which may be metal or is preferably a rigid plastic. The connector has a vertical leg 262 and a horizontal leg 264. Vertical leg 262 is receivable within the generally rectangular area 268 of the rigid reinforcing member extending within the stile. The horizontal leg 264 is receivable within channel 250. In the assembly process, it will be apparent that the horizontal leg 264 will first be inserted into the horizontal rail and the entire assembly forced vertically downward to bring the rail and stile into engagement and to extend leg 262 into the rigid reinforcing member 80A. With the assembly complete, the corner of the assembly is reinforced with member 264 transmitting loads between the vertical and horizontal members to prevent flexing of the corner of the shutter structure.

From the foregoing, it will be apparent that the foregoing invention provides a unique window shutter assembly and structure. Synthetic materials provide significant advantages over conventional construction materials such as wood. The assembly technique lends itself to automation minimizing hand operations inherently necessary with traditional wooden shutter construction.

It will be obvious to those skilled in the art to make various changes, alterations and modifications to the window shutter and method described herein. To the extent such changes, alterations and modifications do not depart from the spirit and scope of the appended claims, they are intended to be encompassed therein.

I claim:

1. A shutter frame comprising:

(a) generally U-shaped vertical stile fabricated from a plastic material and defining a first longitudinally extending channel within said U-shape;

(b) a horizontal rail fabricated from a plastic material and defining a second longitudinally extending channel therein, said vertical stile and horizontal rail being in abutting relationship;

(c) rigid reinforcing means positioned in at least one of said first and second channels;

(d) load transferring means attached to said rigid reinforcing means and extending to the other of said channels to interconnect the vertical stile and horizontal rail and reinforce the frame;

(e) a mounting strip having spaced-apart openings therein, positioned in said first longitudinally extending channel; and (f) louvers having pins associated therewith, said pins being rotatively received in said spaced-apart holes in said mounting strips.

2. The frame of claim 1 wherein said rigid reinforcing means defines an opening therein and wherein said load transferring means includes a projection extending into said opening.

3. The frame of claim 1 wherein said load transferring means comprises a generally L-shaped, rigid member having a first leg connected to said rigid reinforcing means and a second leg extending into the other longitudinally extending channel.

4. The frame of claim 1 wherein said load transferring means comprises insert means receivable in said rigid reinforcing means, a second rigid reinforcing member in the other of said channels and pin means extending between said second rigid reinforcing member and said insert means.

* * * * *